United States Patent [19]

Hammond, Jr. et al.

[11] 4,390,137

[45] Jun. 28, 1983

[54] FORMING A STRAND PACKAGE HAVING MULTIPLE COIL LENGTHS

[75] Inventors: Charles S. Hammond, Jr.; Henry D. Mitchell, Jr., both of Winston-Salem, N.C.

[73] Assignee: Western Electric Company, Inc., New York, N.Y.

[21] Appl. No.: 258,236

[22] Filed: Apr. 28, 1981

[51] Int. Cl.[3] ..... B65H 75/24; B65H 54/10; B65H 55/04

[52] U.S. Cl. ..... 242/54 R; 242/7.09; 242/25 A; 242/110.1

[58] Field of Search ..... 242/54 R, 25 R, 110, 242/110.1, 110.2, 110.3, 25 A, 7.09

[56] References Cited

U.S. PATENT DOCUMENTS

| | | | |
|---|---|---|---|
| 755,096 | 3/1904 | Young | 242/110 X |
| 1,969,924 | 8/1934 | Carter | 242/54 R |
| 2,119,847 | 6/1938 | Grube | 242/54 |
| 2,983,465 | 5/1961 | Skubal | 242/110.1 |
| 3,171,610 | 3/1965 | Hoch | 242/110.1 |
| 4,058,266 | 11/1977 | Beery | 242/54 R |
| 4,078,735 | 3/1978 | Klemer | 242/7.09 |

*Primary Examiner*—Stuart S. Levy
*Assistant Examiner*—Scott J. Haugland
*Attorney, Agent, or Firm*—D. D. Bosben

[57] ABSTRACT

A cable package (20) which includes two coiled cable lengths (22 and 24) interconnected by an intermediate section (26), is formed by winding wire bundles (28 and 30) onto first and second winding sections (44 and 46) of a collapsible reel (42) in sequence. The reel winding sections (44 and 46) are defined by radially-projecting pins 88 which are extendable or retractable by rotation of a hub 84, and which cooperate with cable support rods (80) of the reel to move the reel into an expanded condition for winding and a collapsed condition for removal of the cable package (20). During a winding operation, a wire bundle separator assembly (52) also cooperates with a cable tying device (54) to place memory ties (34) about one of the wire bundles (28 or 30) and binder ties (36) about both of the wire bundles (28 and 30) along the length of the cable package (20).

14 Claims, 8 Drawing Figures

FORMING A STRAND PACKAGE HAVING MULTIPLE COIL LENGTHS

TECHNICAL FIELD

This invention relates to apparatus for forming a strand package having multiple coil lengths, and more particularly to apparatus for forming a cable package having multiple coil lengths on a collapsible winding reel to facilitate subsequent removal of the cable package.

BACKGROUND OF THE INVENTION

In the manufacture of various types of telephone transmission equipment, cables of varying lengths are utilized to interconnect different electrical components of the equipment. Each cable is formed from two smaller cables, or wire bundles, bound together by a series of cable "binder" ties, with one of the wire bundles also being separately bound by a series of cable "memory" ties for identifying one wire bundle from the other wire bundle. Each cable also has a connector plug assembled to one end thereof, and free wires, for wire wrapping, at its opposite end.

In the past, the forming of these cables has been accomplished manually. For example, in one known procedure an operator mounted two lengths of a first wire bundle on an assembly board in parallel relationship, with a midpoint of the wire bundle lengths located at one side of the board, and applied the "memory" cable ties to the wire bundle. Two lengths of a second wire bundle then were similarly mounted adjacent the first wire bundle and the cable "binder" ties were applied about both wire bundles. The bound wire bundles then were removed from the assembly board and, starting from the midpoints thereof, wound into a coil to form a double-length cable package. Connector plugs then were attached to opposite ends of the cable package and the cable package was tested to insure that the connector plugs were properly wired to respective wires in the wire bundles. Subsequently, the cable package was cut at the midpoints of the wire bundles to form two cables each having a connector plug at one end and free wires, for wire wrapping, at its other end.

The foregoing procedure was undesirable for various reasons. For example, the cable was difficult for an operator to manipulate and mount on the assembly board, particularly where a large cable package containing long lengths of cable was involved. Further, the mounting of the wire bundles on the assembly board, applying the cable "memory" and "binder" ties to the wire bundles, and removing the bound wire bundles and coiling them into a cable package, was a tedious and time-consuming operation. It also was difficult to separate the two lengths of cable without unwinding both cable lengths, as a result of the wires of the cables becoming entangled with one another.

In another known procedure, a length of the first and second wire bundles were simultaneously wound about a first set of spaced winding posts extending from an assembly board. The winding posts were spaced such that a given number of windings of the wire bundles about the posts would equal a specified length of cable. A second length of cable connected to the first length of cable by an intermediate portion, then was formed by wrapping the wire bundles about a second set of winding posts positioned adjacent to the first set of winding posts. During the winding operations, the cable "memory" and "binder" ties were applied to the wire bundles. This procedure was undesirable essentially for the same reasons as noted above. Further, accuracy in each length of cable was dependent upon the operator properly counting the number of windings made about each set of winding posts, and the cable "memory" and "binder" ties frequently were not located properly on the wire bundles.

The U.S. Pat. No. 2,119,847 to K. Grube discloses apparatus for winding a strand upon a reel in coils of preselected lengths, wherein each wound coil is bound with band wires after the coil has been wound upon the reel. A plurality of extended coil confining fingers then are manually retracted so that the coil can be pushed along the reel, whereupon the confining fingers again are extended and a next coil is wound upon the reel. Similarly, the U.S. Pat. No. 4,078,735 to B. H. Klemer discloses apparatus for automatically winding a strand on a reel in separate spaced coils of preselected lengths, wherein a strand distributor is periodically shifted relative to the reel in response to a strand length counting mechanism.

SUMMARY OF THE INVENTION

In general, apparatus for forming a strand package having multiple coil lengths comprises rotatable collapsible reel means for winding a strand extending from a strand supply. With the reel means in an expanded condition, the reel means is rotated and relative shifting is caused between the strand and the reel means to cause winding of preselected coil lengths of the strand onto respective winding sections of the reel means in sequence, to form the strand package. Subsequently, the reel means is collapsed to facilitate removal of the formed strand package from the reel means.

More specifically, the reel means includes a plurality of elongated peripheral support members which define the winding sections of the reel means. The support members are movable between expanded positions for a winding operation, and retracted positions to facilitate removal of the strand package from the reel means. The reel means is separated into the winding sections by a plurality of separating pins movable between extended positions for the winding operation, and retracted positions to facilitate removal of the strand package from the reel means. Inner ends of the separating pins are pivotally supported on a hub rotatably mounted on a central support shaft of the reel means for limited movement. Rotation of the hub moves the separating pins between their extended and retracted positions. The separating pins also include shoulders engageable with the elongated peripheral support members for moving the members to their expanded positions as the pins are moved to their extended positions. After the strand package has been formed on the reel means, the strand is cut between the reel means and the supply means. The strand package also may be formed from two strands, to which strand ties are periodically applied during a winding operation. The two strands also may be periodically separated during the winding operation, whereupon a strand tie is applied to only one of the strands for subsequent identification purposes.

DETAILED DESCRIPTION

Figure 1:
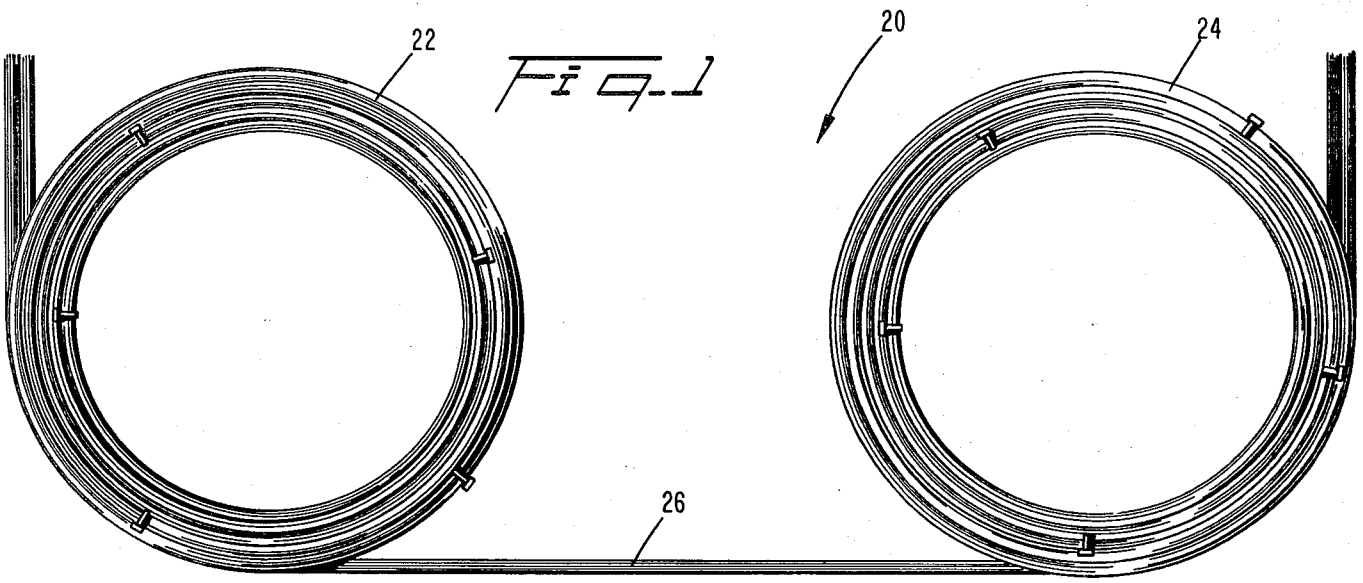
FIG. 1 is a view of a wound cable package which may be formed with an apparatus in accordance with this invention.
Figure 2:
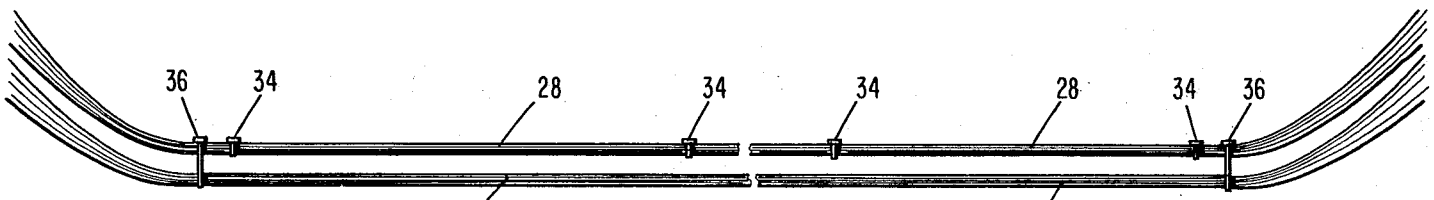
FIG. 2 is a view of end portions of the cable package of FIG. 1 in an unwound condition.

Referring to FIGS. 1 and 2, a cable (strand) package 20 which may be formed with apparatus of this invention, includes two wound coil lengths of cable 22 and 24 interconnected by an intermediate section 26. Each cable length 22 and 24, and the intermediate section 26, is formed from first and second wire bundles or strands 28 and 30 (FIG. 2) and includes a plurality of cable memory ties 34 and cable binder ties 36 secured at designated intervals along the length of the wire bundles. Referring to FIG. 2, which shows end portions of the cable lengths 22 and 24 unwound with the spacing between the wire bundles 28 and 30 exaggerated for purposes of illustration, the cable binder ties 36 surround both of the bundles to bind the bundles together along the length of the cable package 20. The cable memory ties 34 are placed at designated intervals around only the first wire bundle 28 and are provided to facilitate readily distinguishing the first bundle from the second bundle 30. Subsequently, connector plugs (not shown) are attached to the opposite ends of the cable package, the cable package is tested to insure that the connector plugs are properly wired thereto, and the cable package is cut at the center of the intermediate section 26 to form two separate coiled cables having a connector plug at one end and free wires (for wire wrapping) at its opposite end.

Figure 3:
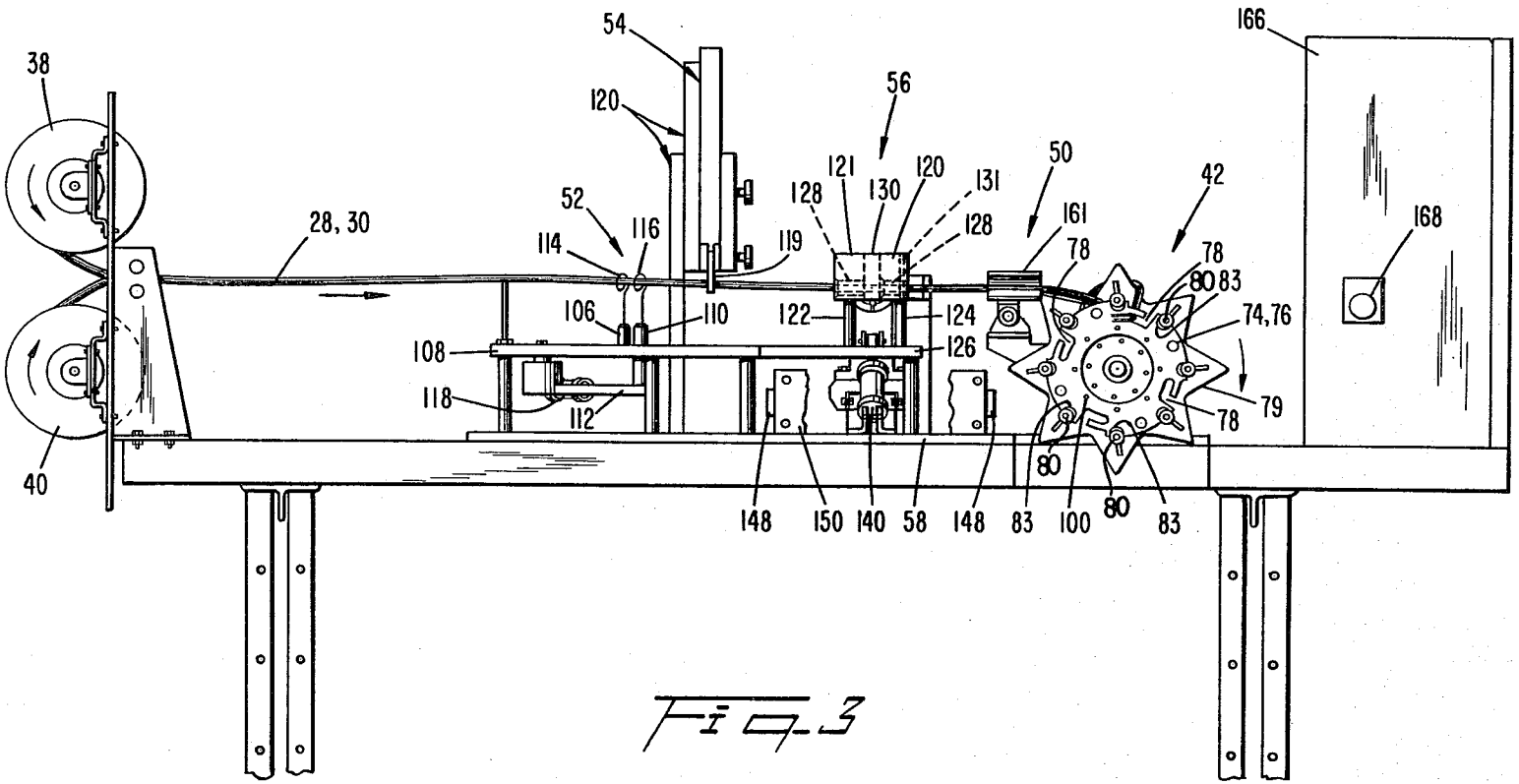
FIG. 3 is an elevational view of apparatus in accordance with this invention.
Figure 4:
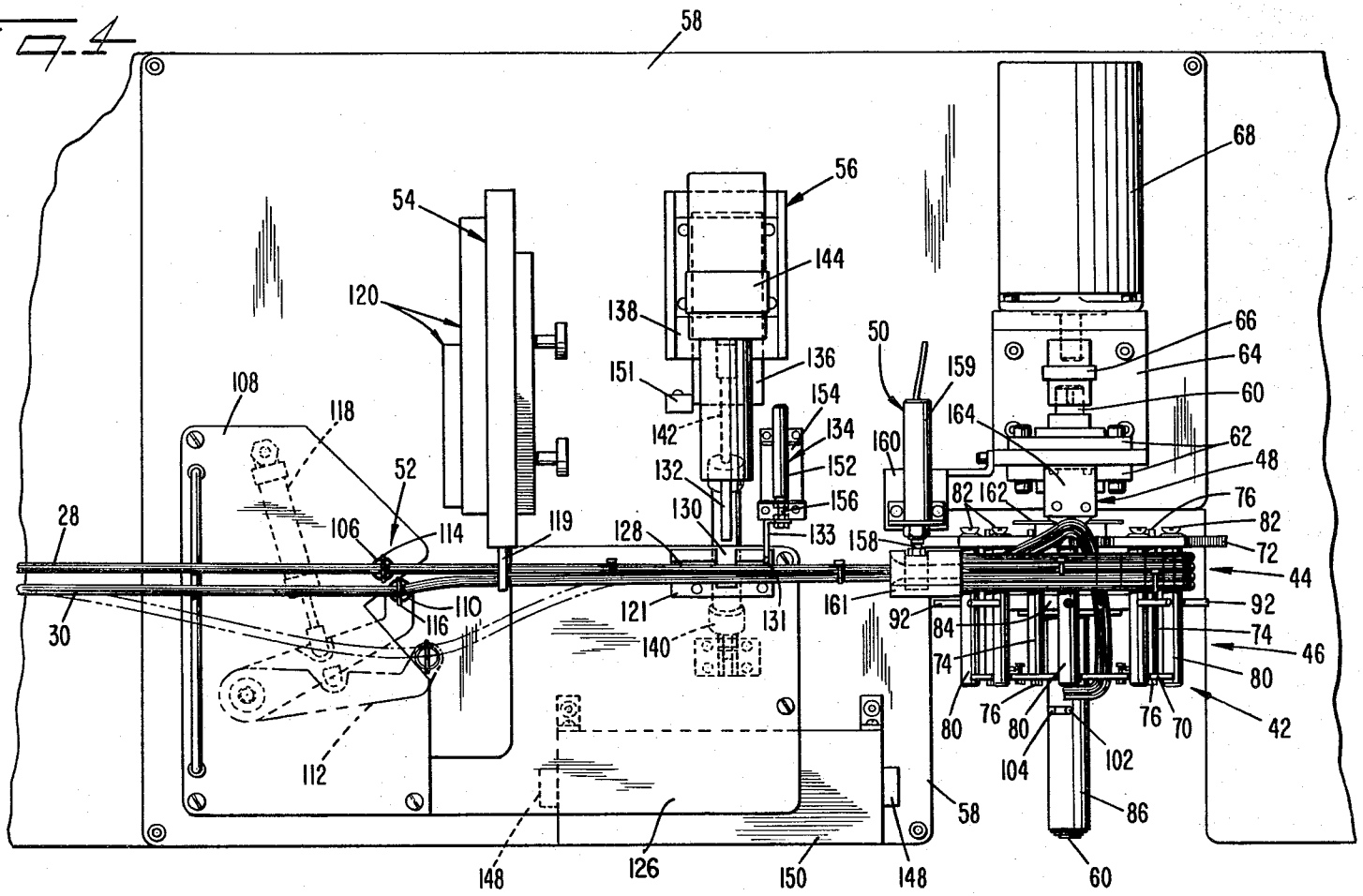
FIG. 4 is an enlarged partial plan view of the apparatus shown in FIG. 3, in a first operating position.

In general, referring to FIGS. 3 and 4, to form the cable package 20, the wire bundles 28 and 30 are wound from a pair of supply reels 38 and 40 onto a collapsible reel 42. The collapsible reel 42 is divided into first and second winding sections 44 and 46 (FIGS. 4 and 5), each winding section being provided for receiving one of the two cable lengths 22 and 24, respectively. The collapsible reel 42 is rotated in a clockwise direction, as indicated by the arrow in FIG. 3, which initially causes a measured length of the wire bundles 28 and 30 from the supply reels 38 and 40, as determined by a counter device 48 (FIGS. 4 and 5), to be wound onto the first winding section 44 of the reel. Once a designated length of the cable package 20 has been wound onto the first winding section 44 of the reel 42 to form the first cable length 22, a distributor mechanism 50 is actuated to push the advancing wire bundles 28 and 30 from alignment with the first winding section 44 of the reel, into alignment with the second winding section 46 of the reel, for winding thereon to form the second cable length 24. As the cable package 20 is being wound onto the first and second winding sections 44 and 46 of the reel 42, the first and second wire bundles 28 and 30 pass through a separator assembly 52, which cooperates with a cable tying device 54 to facilitate the placement of the cable memory ties 34 and the cable binder ties 36 at the selected intervals along the length of the package. A cutter assembly 56, which is mounted onto a base plate 58 of the apparatus along the travel path of the wire bundles 28 and 30, is provided to sever the cable package 20 from the supply reels 38 and 40 once the designated length of the package has been wound onto the reel 42.

Referring to FIGS. 4–7, the collapsible reel 42 includes a center support shaft 60 which is mounted for rotational movement in bearings 62 (FIG. 4) on one leg of a U-shaped support frame 64 mounted on the base plate 58. The shaft 60 is connected through a coupling 66 to a drive motor 68 mounted on a second leg of the U-shaped support frame 64. Mounted onto the shaft 60 is an assembly comprising a front annular plate 70 (FIGS. 4 and 5) and a rear plate 72, the front and rear plates being interconnected by a plurality of connecting rods 74 extending therebetween. More specifically, the rear plate 72 is fixedly mounted on the support shaft 60, with the front plate mounted on the rear plate in cantilevered relationship by the connecting rods 74. The connecting rods 74 are fastened to the front plate 70 and rear plate 72 by nuts 76. The front plate 70 includes a series of circumferentially spaced cable-anchoring slots 78 (FIG. 3) and the rear plates include a series of cable-anchoring peripheral serrations 79 (FIG. 3).

The collapsible reel 42 further includes a plurality of cable support rods 80 which also extend between the front plate 70 and rear plate 72 and which provide support surfaces for the cable package 20 as it is being wound onto the reel. One end of each cable support rod 80 extends through an aperture 81 (FIGS. 6, 7 and 8) in the rear plate 72 and is loosely secured therein by a screw-and-washer assembly 82 to permit pivotal movement of the rod 80 in the aperture. As is best shown in FIGS. 3 and 8, an opposite outer end of the cable support rod 80 is disposed within an open notch 83 formed in the front plate 70.

Figure 6:
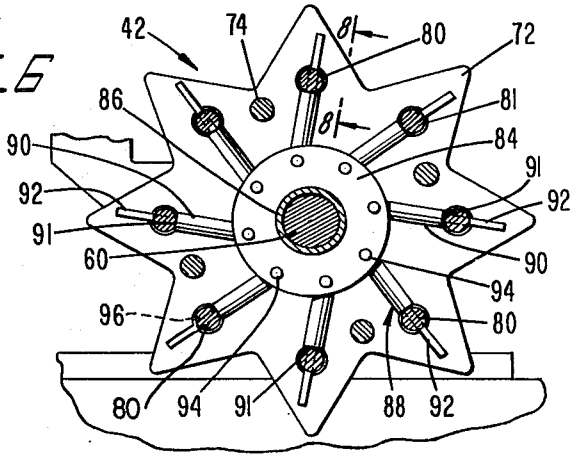
FIG. 6 is a cross-sectional view of a portion of the apparatus, as seen along the line 6—6 in FIG. 5, illustrating an expanded operational condition of the apparatus.
Figure 7:
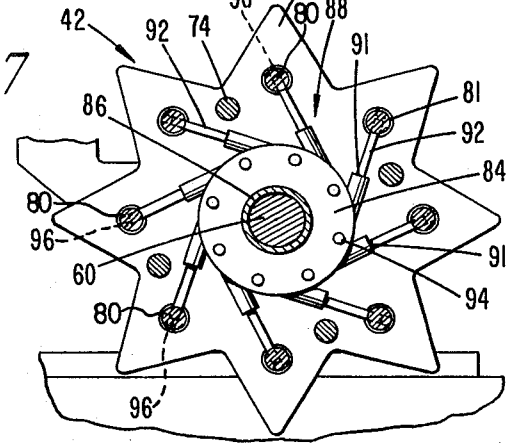
FIG. 7 is a cross-sectional view similar to FIG. 6, showing the apparatus in a collapsed inoperative condition.
Figure 5:
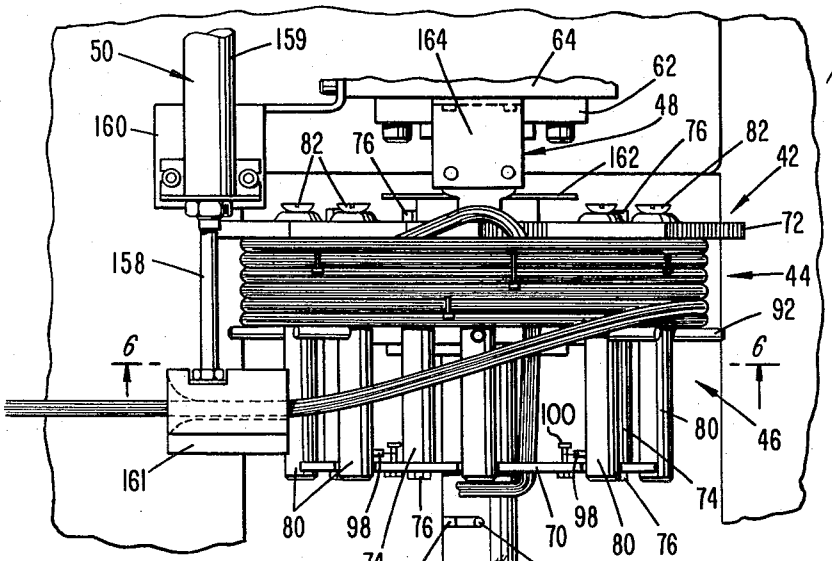
FIG. 5 is a further enlarged partial plan view of the apparatus shown in FIG. 3, in a second operating position.

Referring to FIGS. 6 and 7, a hub 84 with a tubular handle 86 extending therefrom is mounted for limited rotatable movement onto the reel support shaft 60 and carries a plurality of pins 88 which divide the reel 42 into the first and second winding sections 44 and 46 (FIG. 5). Each of the pins 88 includes an enlarged lower section 90 having a shoulder portion 91, and a narrow upper section 92, wherein the lower section is pivotally secured to the hub 84 by a dowel pin 94. Each upper section 92 of the pin 88 extends into an aperture 96 formed in each of the cable support rods 80 of the reel 42.

With further reference to FIGS. 6 and 7, the collapsible reel 42 is capable of assuming an expanded position as shown in FIG. 6 when the tubular handle 86 is rotated counterclockwise and a collapsed position as shown in FIG. 7 when the handle is rotated clockwise. In the collapsed position (FIG. 7), the pins 88 on the hub 84 assume a position wherein the shoulders 91 of the enlarged sections 90 of the pins 88 do not engage the cable support rods 80 of the reel 42. The outer end of each rod 80 then is biased into the bottom of the associated notch 83 of the front plate 70, as illustrated in broken lines in FIG. 8, by a coil spring 98 (FIGS. 5 and 8) extending between a bolt 100 on the front plate 70 of the reel 42, and one end of the cable support rod, to retain the reel 42 in the collapsed position.

Figure 8:
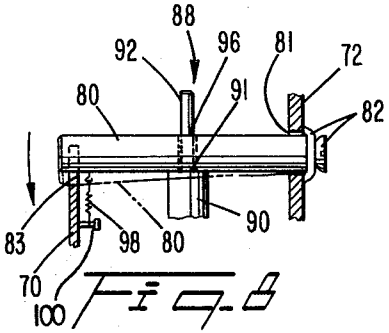
FIG. 8 is a cross-sectional view taken along the line 8—8 in FIG. 6, further illustrating the expanded and collapsed conditions of the apparatus.

In the expanded position (FIG. 6) of the reel 42, the pins 88 on the hub 84 assume an overcenter position in which the shoulder 91 of the enlarged section 90 of each pin engages the area immediately surrounding the aperture 96 of the associated cable support rod 80 and pushes the rod outward, thereby causing pivotal movement of the support rod to a position as shown in solid lines in FIG. 8, to expand the reel as shown in FIG. 6. The coil springs 98 (FIGS. 5 and 8) then retain the reel 42 in the expanded position. The shaft 60 of the collapsible reel 42 includes a dowel pin 102 (FIG. 5) which rides in a slot 104 formed in the handle 86 of the hub 84 to limit the rotational movement of the handle as noted above.

Referring to FIGS. 3 and 4, the separator assembly 52 includes a fixed post 106 secured to an upper support plate 108 of the apparatus and a movable post 110 mounted onto a pivot arm 112 on the upper support plate. The fixed post 106 and the movable post 110 include eyelets 114 and 116, respectively, through which are threaded the first and second wire bundles 28 and 30. An intermediate section of the pivot arm 112 is secured to an air cylinder 118 (best shown in FIG. 4), which when actuated causes pivotal movement of the pivot arm from a closed position as shown in solid lines in FIG. 4 to an open position as shown by the broken lines of FIG. 4. When the separator assembly 52 is in the open position such that the eyelets 114 and 116 are spaced from each other as shown by the broken lines of FIG. 4, only the first bundle 28 will pass through jaws 119 of the tying device 54 and consequently the tying device will place a cable tie, which then functions as one of the memory ties 34, about the first bundle 28. When the separator assembly 52 is in the closed position as shown in FIG. 4, the first and second wire bundles 28 and 30 are positioned in a closely spaced relationship and are both positioned within the jaws 119 of the cable tying device 54 such that a cable tie, which then functions as one of the binder ties 36, can be placed about both bundles by the tying device.

The tying device 54 may be of any suitable type capable of applying cable ties about one or both of the wire bundles 28 and 30, to provide the memory ties 34 or the cable binder ties 38, respectively, such as the pneumatic Model 30002AA7 Tymatic Cable Binding Tool available from Gardner-Denver Company of Grand Haven, Mich. The cable tying device 54 is suitably clamped to a vertical support plate assembly 120 secured at a lower end thereof to the base plate 58.

Adjacent the cable cutter assembly 56, a U-shaped guide block 121 (FIGS. 3 and 4) for capturing the wire bundles 28 and 30 for movement along a confined path is secured by screws to a pair of support posts 122 and 124 mounted on a second upper support plate 126 of the apparatus. The guide block 121 includes a cable receiving passage 128 which extends along the length of the block for receiving the wire bundles 28 and 30 longitudinally therein. First and second access notches 130 and 131 also are formed in the guide block 121. The first access notch 130 is provided to receive a pair of opposed scissors-type jaws 132 (one shown in FIG. 4) of the cutter assembly 56 to sever the cable package 20 from the supply reels 38 and 40. The second access notch 131 is provided to receive a blade 133 (FIG. 4) of a cable clamp assembly 134 for retaining the trailing end of the cable package 20 in the block 121 during and after the severing of the cable package from the supply reels 38 and 40.

The cutter assembly 56 (FIG. 4), which may be of any suitable type, includes a mounting block 136 and a slide 138 mounted for sliding movement on the block. An air cylinder 140, having one end pivotally mounted on the base plate 58, has a piston rod 142 which is mounted onto a pivot bracket (not shown) secured to the slide 138 of the cutter assembly 56. An air-activated cutter 144, which includes the pair of opposed scissors-type jaws 132 (only one shown), is secured to the slide 138. To cut the wire bundles 28 and 30 within the cable guide block 121, a pair of series-connected actuating buttons 148 are depressed at opposite ends of a two-handed safety switch mechanism 150, causing air cylinder 140 to be actuated, which causes slide 138 to move the jaws 132 forward into the first access notch 130 in the guide block 121 about the wire bundles 28 and 30. As the slide 138 reaches its fowardmost position, an air valve 151 (FIG. 4) is actuated by the slide, causing cutter 144 to close the jaws 132 and to sever the cable package 20 from the portions of the wire bundles 28 and 30 extending to the supply reels 38 and 40.

The cable clamp 134 (FIG. 4) includes an air cylinder 152 mounted onto a support bracket 154, the air cylinder having a piston rod 156 with the clamping member 133 secured at one end thereof. When the piston rod 156 is in the extended position, the clamping member 133 extends into the second access notch 131 of the cable guide block 121 to retain the trailing end of the cable package 20 within the cable guide block.

The distributor mechanism 50 includes an air cylinder 159 (FIGS. 4 and 5) mounted on a support bracket 160 secured to one leg of the U-shaped support frame 64. An essentially crescent-shaped guide member 161, which is open around one-quarter of its periphery to facilitate placing the wire bundles 28 and 30 therein, is secured onto the end of a piston rod 158 of the air cylinder 159 for aligning the wire bundles with the first or second winding sections 44 or 46 of the collapsible reel 42.

To measure the amount of the wire bundles 28 and 30 to be wound onto each winding section 44 and 46 of the reel 42, the counter device 48 (FIGS. 4 and 5) includes a disk 162 mounted onto the drive shaft 60 of the reel 42. The disk 162 includes a plurality of ferromagnetic peripheral vanes (not shown in detail) which, as the reel 42 is rotated, pass through a sensor switch 164 mounted onto one leg of the U-shaped support frame 64. Thus, as the drive shaft 60 rotates the sensor switch opens and closes (e.g., 8 times per revolution of the shaft) to indicate the number of turns of the reel 42, and therefore the length of the cable package 20 wound onto the reel.

Control of the apparatus to produce the desired operating sequence can be accomplished by utilizing a controller 166 (FIG. 3), which may be a programmed or punched-tape device containing suitable logic circuitry (not shown) and associated electrical circuits (not shown). In this connection, upon the depression of a start button 168 (FIG. 3) of the controller 166, the drive motor 68 (FIG. 4) is energized to begin rotating the collapsible reel 42 in a clockwise direction in FIG. 3 to wind the wire bundles 28 and 30 on the first winding section 44 (FIGS. 4 and 5) of the reel. Then, as the counter device 48 reaches preselected "counts", which are indicative of the length of the wire bundles 28 and 30 which has been wound on the reel 42, the controller 166 causes the desired operations of the apparatus to occur. For example, when a first "count" of the counter mechanism 48 is reached, the controller 164 de-energizes the drive motor 68 to stop rotation of the reel 42, and energizes the tying device 54 to apply one of the binder ties 38 about both of the wire bundles 28 and 30. Clockwise rotation of the reel 42 then is continued until the counter mechanism 48 has reached a second "count", whereupon the reel is again stopped and the air cylinder 118 of the wire bundle separator 52 is operated to move the separator eyelets 114 and 116 to spaced-apart positions, to separate the wire bundles 28 and 30 as shown by broken lines in FIG. 4. The tying device 54 then is operated to apply one of the memory ties 34 about the wire bundle 28. The separator air cylinder 118 then is operated to move the separator eyelets 114 and 116 back to a closed position as shown in solid lines in FIG. 4 and the reel drive motor 68 is re-energized. This procedure is then repeated during the forming of the remainder of the cable package 20 on the reel 42.

Further, when the counter device 48 reaches a "count" representative of a desired length of the first cable coil 22, the controller 166 operates the distributor air cylinder 159 (FIGS. 4 and 5) to move the distributor guide member 161 from its position in alignment with the first winding section 44 of the reel 42, into its position in alignment with the second winding section 46 of the reel, to begin forming the second cable coil 24. When a "count" representative of a desired length of the second cable coil 24 (and thus of the cable package 20) is reached by the counter device 48, the reel drive motor 68 is again de-energized, to stop the reel 42. Air cylinder 152 then is actuated to advance clamp 132 to retain the trailing ends of the wire bundles 28 and 30 in the guide block 121. Manual safety switch 150 may then be operated to cause the cable cutter 56 to sever wire bundles 28 and 30. The machine operator then rotates handle 86 to collapse reel 42, as shown in FIGS. 7 and 8, de-energizes the clamp air cylinder 152 to retract the clamp 132, and removes the thus formed cable package 20 from the reel.

In summary, a new and improved apparatus is disclosed for forming a cable package having multiple coiled cable lengths, such as the cable package 20 having the coiled cable lengths 22 and 24. The apparatus includes the collapsible reel 42, which is movable to an expanded condition as viewed in FIG. 6 for winding the wire bundles 28 and 30 thereon, and to a collapsed condition as viewed in FIGS. 7 and 8 to facilitate removal of the cable package 20 from the reel.

More specifically, when the reel 42 is in the expanded condition, the upper sections 92 of the pins 88 are extended through the apertures 96 of the cable support rods 80 and project beyond the support rods to divide the reel into the first and second winding sections 44 and 46, with the shoulders 91 of the lower sections 90 of the pins 88 retaining the cable support rods 80 into their outermost positions as shown in FIG. 6. During a winding operation, the distributor 161 then sequentially aligns the advancing wire bundles 28 and 30 with the first winding section 44 of the reel 42 to form the first cable length 22 on one side of the pin upper sections 92, and with the second winding section 46 of the reel to form the second cable length 24 on the opposite side of the pin upper sections. When the reel 42 is moved to the collapsed condition, the upper sections 90 of the pins 88 are withdrawn into the apertures 96 of the cable support rods 80 as viewed in FIG. 7, and the outer ends of the cable support rods are biased by the springs 98 radially inward to their innermost positions as shown in FIG. 8 in broken lines, to facilitate the removal of the cable lengths 22 and 24 from the reel. During the winding operation, the separator assembly 52 also cooperates with the cable tying device 54 to place the memory ties 34 and the binder ties 36 along the length of the cable package 20.

What is claimed is:

1. Apparatus for forming a strand package having multiple coil lengths, which comprises:

rotatable, collapsible reel means for winding a strand extending from a strand supply;

means for expanding the reel means into an expanded condition for a winding operation;

means for rotating the reel means to wind the strand from the strand supply onto the reel means;

means for causing relative shifting of the strand and the reel means to cause winding of preselected coil lengths of the strand onto respective winding sections of the reel means in sequence, to form the strand package;

means for collapsing the reel means to facilitate removal of the formed strand package from the reel means; and means for separating the reel means into the winding sections, the separating means being movable into an extended condition for separating the reel means into the winding sections, and into a retracted condition to facilitate removal of the strand package from the reel means, and a part of the separating means forming a part of the means for expanding and collapsing the reel means.

2. Apparatus as recited in claim 1, in which:

the reel means includes a plurality of elongated peripheral members defining the winding sections of the reel means, the elongated members being movable between expanded and retracted positions;

the separating means comprises a plurality of pins movable between extended positions and retracted positions relative to the elongated members; and the part of the separating means which forms a part of the means for expanding and collapsing the reel means includes shoulder means on the pins for moving the elongated members to their expanded positions when the pins are moved to their extended positions.

3. Apparatus as recited in claim 2, in which: the separating pins slidably extend through respective ones of the elongated peripheral members.

4. Apparatus as recited in claim 2, in which the reel means further includes:

a central rotatable support shaft;

spaced support means fixedly mounted on the central rotatable shaft for rotation therewith, the elongated peripheral members being movably mounted on the spaced support means;

a rotatable hub mounted on the central rotatable support shaft for rotation therewith and for limited rotation relative thereto, the separating pins having inner ends pivoted on the hub; and means for rotating the hub relative to the central rotatable support shaft to move the separating pins between their extended and retracted positions.

5. Apparatus as recited in claim 2, in which the reel means further includes:

a central support shaft;

a rotatable hub mounted on the central support shaft for limited movement, the separating pins having inner ends pivoted on the hub; and means for rotating the hub to move the separating pins between their extended; and retracted positions.

6. Apparatus as recited in claim 2, in which the reel means further includes:

a central rotatable support shaft; and spaced support means fixedly mounted on the central rotatable support shaft for rotation therewith, the elongated peripheral members being movably mounted on the spaced support means.

7. Apparatus as recited in claim 1, in which the strand package is formed by two strands being wound on the reel means simultaneously, and which further comprises:

means for periodically separating the two strands as the strands are being wound on the reel means; and means for applying ties to one of the strands when the strands are separated by the strand separating means, and for applying ties about both of the strands when the strands are not separated by the strand separating means.

8. Apparatus as recited in claim 1, which further comprises:

means for cutting the strand between the reel means and the strand supply after the strand package has been formed on the reel means.

9. A collapsible reel, which comprises:

peripheral strand support means for supporting strand portions on the reel, the strand support means being movable between expanded and retracted positions;

means for moving the strand support means between the expanded and retracted positions; and means for separating portions of the strand support means to define separate strand-support sections, the separating means being movable into an extended condition for separating the portions of the strand support means into the strand-support sections, and into a retracted condition to facilitate removal of the strand portions from the strand-support sections, with a part of the separating means forming a part of the means for moving the strand support means between the expanded and retracted positions.

10. A collapsible reel as recited in claim 9, in which:

the strand support means includes a plurality of elongated peripheral members movable between expanded and retracted positions;

the separating means comprises a plurality of separating pins movable between extended positions and retracted positions relative to the elongated members; and the part of the separating means which forms a part of the means for moving the strand support means between the expanded and retracted positions includes shoulder means on the pins for moving the elongated members to their expanded positions when the pins are moved to their extended positions.

11. A collapsible reel as recited in claim 10, in which:

the separating pins slidably extend through respective ones of the elongated peripheral members.

12. A collapsible reel as recited in claim 10, which further comprises:

a central support shaft;

a rotatable hub mounted on the central support shaft for limited movement, the separating pins having inner ends pivoted on the hub; and means for rotating the hub to move the separating pins between their extended and retracted positions.

13. A collapsible reel as recited in claim 10, which further comprises:

a central rotatable support shaft; and spaced support means fixedly mounted on the central rotatable support shaft for rotation therewith, the elongated peripheral members being movably mounted on the spaced support means.

14. A collapsible reel as recited in claim 10, which further comprises:

a central rotatable support shaft;

spaced support means fixedly mounted on the central rotatable shaft for rotation therewith, the elongated peripheral members being movably mounted on the spaced support means;

a rotatable hub mounted on the central rotatable support shaft for rotation therewith and for limited rotation relative thereto, the separating pins having inner ends pivoted on the hub; and means for rotating the hub relative to the central rotatable support shaft to move the separating pins between their extended and retracted positions.

* * * * *